US006640655B1

(12) United States Patent
Manzak et al.

(10) Patent No.: US 6,640,655 B1
(45) Date of Patent: Nov. 4, 2003

(54) SELF TRACKING SENSOR SUSPENSION MECHANISM

(75) Inventors: Paul T. Manzak, Houston, TX (US); Carl R. Torres, Jr., Kingwood, TX (US)

(73) Assignee: Varco I/P, Inc., Houston, TX (US)

( * ) Notice: Subject to any disclaimer, the term of this patent is extended or adjusted under 35 U.S.C. 154(b) by 82 days.

(21) Appl. No.: 09/677,883

(22) Filed: Oct. 3, 2000

(51) Int. Cl.[7] ..... E21B 47/08
(52) U.S. Cl. ..... 73/865.8
(58) Field of Search ..... 73/86, 865.8, 623, 73/634; 33/544, 544.1–544.5, 777; 324/220, 221, 173, 174, 168, 777

(56) References Cited

U.S. PATENT DOCUMENTS 2,812,587 A * 11/1957 Roussin ..... 33/544.2
3,460,028 A 8/1969 Beaver et al.
3,593,112 A * 7/1971 Barton et al. ..... 324/220
3,940,855 A * 3/1976 Ver Nooy et al. ..... 33/544
4,105,972 A 8/1978 Smith
4,205,266 A * 5/1980 Lichtenberg ..... 324/221
4,576,097 A 3/1986 Foster
6,023,986 A 2/2000 Smith et al.
6,076,407 A * 6/2000 Levesque et al. ..... 73/623

* cited by examiner

*Primary Examiner*—Robert Raevis
(74) *Attorney, Agent, or Firm*—Finnegan, Henderson, Farabow, Garrett & Dunner LLP

(57) ABSTRACT

The invention relates to a self-tracking sensor mechanism for use with a smart pipeline inspection gauge, commonly termed a "smart pig". The self-tracking sensor mechanism has a link pivotally attached to a body portion of the pig and a spring for urging the link in a direction away from the body portion of the pig and toward the wall of the pipeline being inspected. A trailing arm is pivotally connected to the link. The trailing arm has a sensor that is maintained in contact with the pipeline interior surface to be inspected during travel of the pig through the pipeline.

5 Claims, 2 Drawing Sheets

SELF TRACKING SENSOR SUSPENSION MECHANISM

FIELD OF THE INVENTION

This invention relates to a self-tracking sensor suspension mechanism for use with smart pipeline inspection gages, commonly termed "smart pigs", used in the inspection of pipelines. The sensor suspension mechanism improves the data gathering capabilities of pigs in the presence of varying conditions of the surfaces being inspected. Although the invention is most applicable to the interior inspection of pipelines, it is also susceptible to other applications, including inspection of tank interiors.

BACKGROUND OF THE INVENTION

In-line inspection tools, or "smart pigs" as they are commonly referred to are used to gather information with respect to the condition of a pipeline through which the pig is propelled. Pigs are also used to perform more simple tasks such as cleaning of pipelines; however, the term "smart pig" implies a tool for performing a more complex task. This includes use in the measurement of metal loss due to corrosion, cracks due to stress corrosion, pipeline deformity, and the like.

A smart pig is typically propelled along the pipeline under pressure or pressure difference of the pipeline fluid. The pipeline fluids may be gas, liquid, or a combination of both. A smart pig that is introduced to a pipeline having an appropriate pressure differential and volumetric flow rate will be propelled at the same rate as the fluid.

The primary purpose of smart pigs is to determine the amount of metal loss or removed metal in the pipeline. Metal loss may occur as a result of corrosion on the inside or outside of the pipe. It may also occur as a result of gouging of the pipeline exterior as a result of third party damage. The industry standard for measuring metal loss is the use of Magnetic Flux Leakage (MFL). Other techniques, such as acoustics, are also used.

In obtaining data from within the pipeline, such as MFL data, the smart pig will have a mechanism for propelling it down the pipeline, typically a tractor, and means for magnetizing the pipeline wall, typically called a magnetizer. In addition means are provided to sense MFL and for powering the data acquiring components of the smart pig. Likewise, means for storing the gathered data will be provided.

The sensors used for measuring the MFL signal are positioned radially in spaced apart relation about a body portion of the magnetizer of the smart pig. The suspension mechanisms typically used for mounting the sensors to the body portion of the magnetizer include the cage type, the parallel suspension type and the single arm type.

With the cage type the sensor mechanism is maintained against the pipe wall through the use of links and springs. This mechanism allows the sensor to adjust for varying wall thicknesses of the pipe. Slots are provided at each end of a head to which the sensor is connected to enable them to tilt relative to one another. This type mechanism works very well in smooth pipe where there are no dents, large welds or other protuberances along the pipe wall. In the event of a significant protuberance, however, the sensor lifts off the pipe wall and the measuring of the MFL signal is degraded.

The parallel suspension type consists of a four bar linkage mechanism. The linkage mechanism allows the sensor to traverse the pipe inner surface during movement parallel to the pig axis. The sensor carrier, in this case a magnetizer, has means of support that urges its axis parallel to the nominal axis of the pipe. With this arrangement, the sensor is connected to the links and is maintained against the pipe wall during passage of the pig through the pipeline. As with the cage type these devices are spring-loaded to urge the sensor toward the pipe wall. This type of suspension has the same disadvantage as discussed above with respect to the cage type. Rocking of the sensor carrier also results in movement of the sensor relative to the pipe inner surface thus degrading the measurement of the MFL signal.

A third type suspension mechanism is designated as the single arm type. In this device a single arm is pivotally connected at one end to the body portion of the pig. A spring urges the opposite end containing the sensor against the pipe wall during travel of the pig through the pipeline. This mechanism has a disadvantage that depressions on the surface being inspected tilts the sensor away from the surface to degrade the MFL signal. In addition any rocking motion of the pig during travel through the pipeline causes the sensor to correspondingly tilt to degrade the signal.

SUMMARY OF THE INVENTION

It is accordingly a primary object of the present invention to provide a self-tracking sensor suspension mechanism for use with smart pigs that overcomes the difficulties of prior art devices, as discussed above, to improve the quality of inspection and specifically the quality of a MFL detected signal.

An additional object of the invention is to provide a self-tracking sensor suspension mechanism for use with smart pigs that functions to hold a sensor or sensors at a selected orientation, which may be parallel, perpendicular or angular, relative to a surface being inspected, and particularly the inner surface of a pipe, regardless of surface irregularities.

In accordance with the invention, a self-tracking sensor suspension mechanism for use with a pig traveling through a pipeline is provided. The pig includes a body portion to which a plurality of self-tracking sensor mechanisms are attached. Each of these mechanisms has a link pivotally attached to the body portion of the pig at one end of the link. Means are provided for urging the link in a direction away from the body portion of the pig. A trailing arm is pivotally connected at one end thereof to the link. Means are provided for urging the trailing arm in a direction away from the body portion. A sensor is embedded within or connected to the surface portion of the trailing arm for contact with a pipeline interior surface when the pig is traveling within the pipeline.

The means for urging the link in a direction away from the body portion of the pig may be a spring, as may be the means for urging the trailing arm in a direction away from the body portion.

The link may be pivotally attached to the body portion by a pin extending through the link at the end thereof attached to the body portion.

The trailing arm may be pivotally connected to the link by a pin extending through the link and the trailing arm.

DESCRIPTION OF THE PREFERRED EMBODIMENTS

Figure 1:
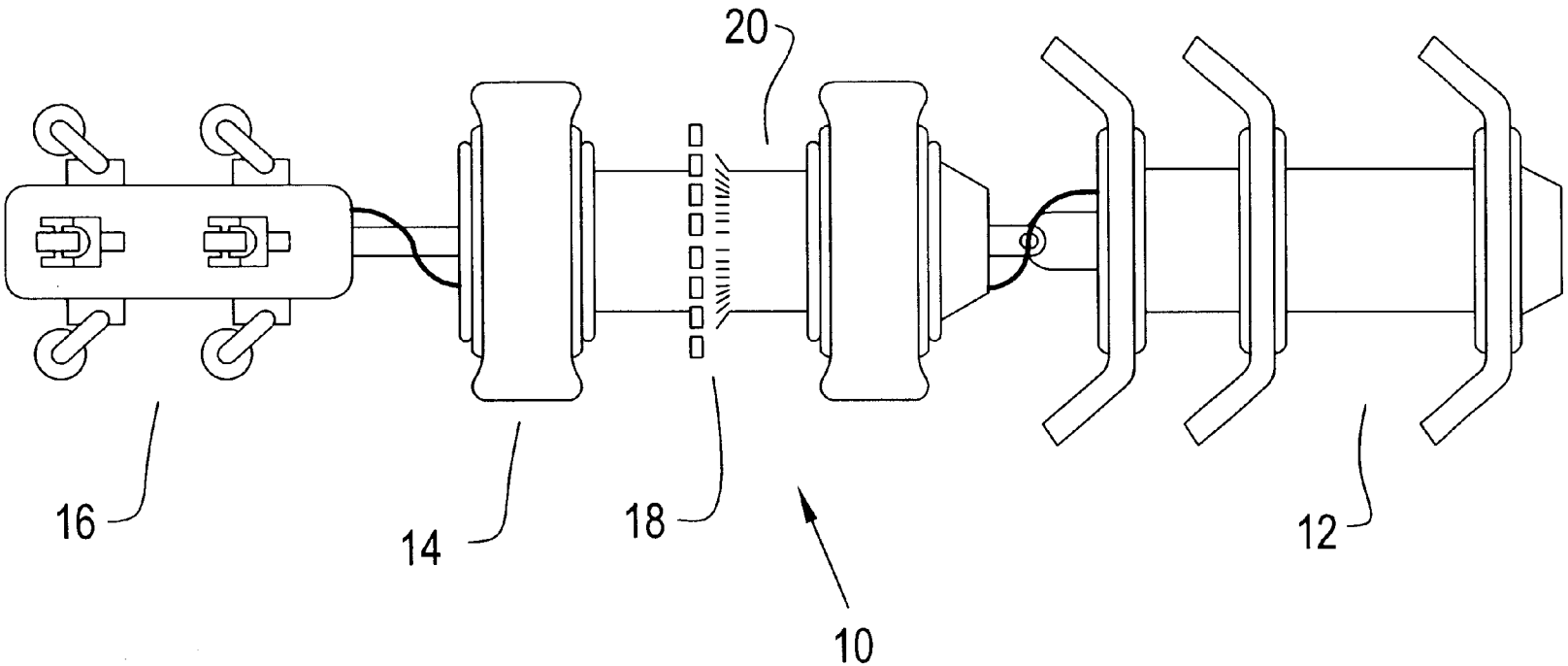
FIG. 1 is an elevational view of a typical smart pig of the type with which the self-tracking sensor suspension mechanism of the invention would be used.

Referring to the drawings and presently to FIG. 1, there is shown a typical smart pig designated generally as 10 and having a tractor or drive section 12 a magnetizer section 14 and a data storage section 16 or recorder. The magnetizer section has a plurality of sensors 18 mounted on a body portion 20 of the magnetizer section. In accordance with conventional practice the tractor portion 12 pulls the magnetizer, recorder, and associated sensors through the pipeline where MFL data is obtained by the sensors 18 for storage in the data storage section 16. This is conventional practice and does not constitute a part of the invention.

Figure 2:
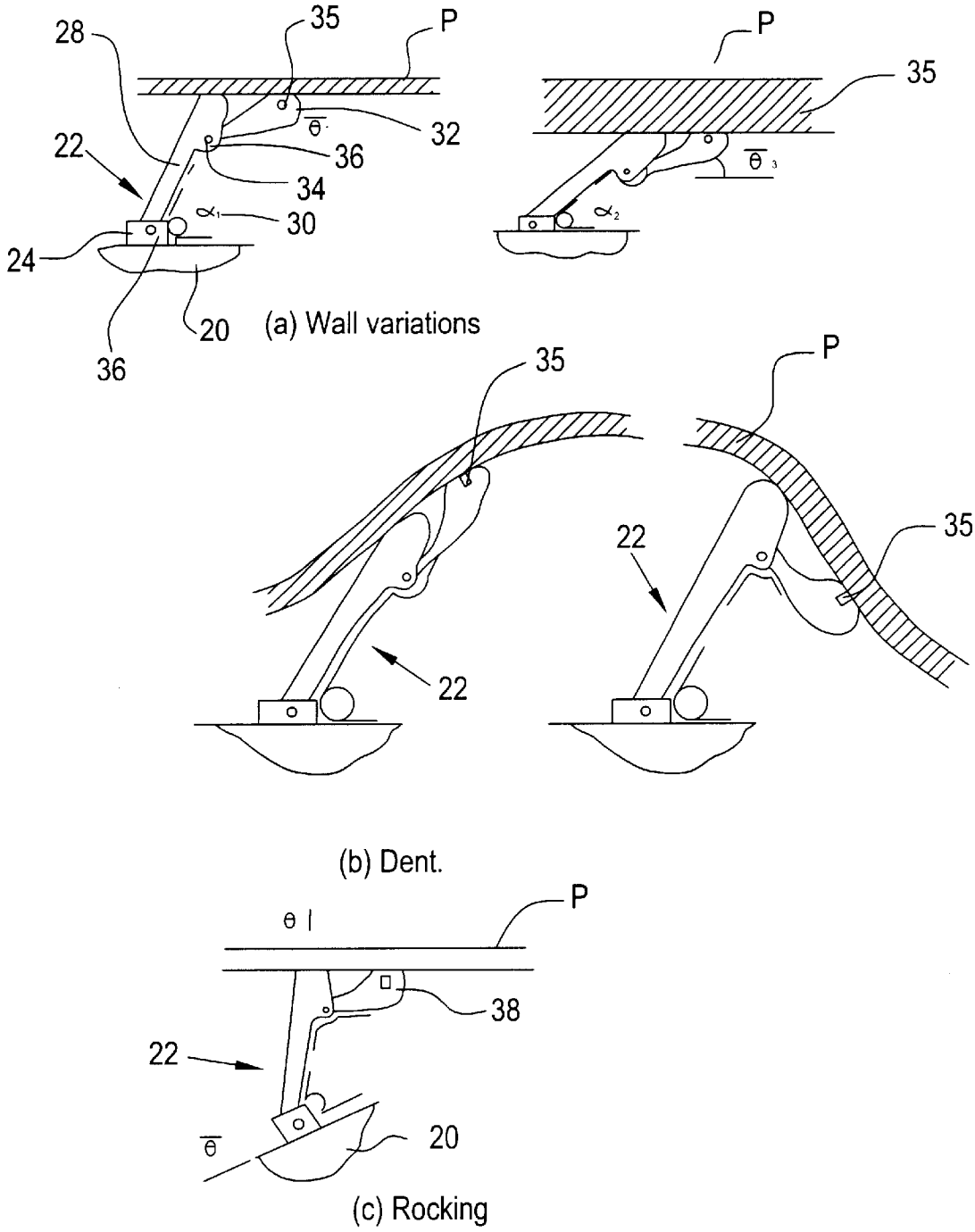
FIG. 2 are views of the self-tracking sensor suspension mechanism of the invention shown in various applications during inspection of a pipeline.

With respect to FIGS. 2*a, b,* and *c,* there is shown the self-tracking sensor suspension mechanism in accordance with an embodiment of the invention. The sensor suspension mechanism is designated generally as 22 and is shown in association with a pipeline interior designated in cross-section as P. The suspension mechanism 22 has a base 24 that is secured, as by welding or fastening (not shown) to the body portion of the magnetizer section 20, which is shown in FIG. 1 and described above. A pin 26 that extends through the base 24 and a pivot link 28 permits pivoting of the link 28 about the axis of the pin 26. A spring 30 is connected to the base and urges the link 28 away from the body portion 20 of the magnetizer 14, and toward the interior surface of the pipe P. At the opposite end of the link 28 connected to the base 24 is a trailer arm 32 mounted on pin 34 for rotation relative to the link 28. The trailer arm 32 is urged by spring 36 away from the body portion 20 and into engagement with the interior surface of the pipeline. A sensor 38 is mounted in the trailing arm 32 and is in engagement with the interior of the pipeline P.

As shown in FIG. 2*a,* increases or decreases in the wall thickness of the pipe P do not affect the position of the sensor 38 relative to the interior surface of the pipeline. In both instances the sensor is in proper engagement for receiving MFL data.

Likewise, with respect to FIG. 2*b,* curvature of the pipeline interior does not impair contact of the sensor 38 with the interior pipeline surface.

This is likewise the case with respect to FIG. 2*c* where rocking of the pig and the magnetizer 14 and associated body portion 20 does not cause the sensor 38 to lose contact with the pipeline interior.

What is claimed is:

1. A pig for traveling within a pipeline, said pig including a body portion to which a plurality of self-tracking sensor mechanisms are attached;

each of said self-tracking sensor mechanisms comprising a link pivotally attached to said body portion of said pig at one end thereof, first means for urging said link in a direction away from said body portion, a trailing arm pivotally connected at one end thereof to said link, second means independent of said first means for urging said trailing arm in a direction away from said body portion, and a sensor connected to a surface portion of said trailing arm for contact with a pipeline interior surface when said pig is traveling within said pipeline.

2. The pig of claim 1, wherein said first means for urging said link in a direction away from said body portion is a first spring.

3. The pig of claim 2, wherein said second means for urging said trailing arm in a direction away from said body portion is a second spring.

4. The pig of claim 3, wherein said link is pivotally attached to said body portion by a pin extending through said link at said one end thereof.

5. The pig of claim 4, wherein said trailing arm is pivotally connected to said link by a pin extending through said link and said trailing arm at said one end of said trailing arm and at said another end of said link.

* * * * *